US010625406B2

(12) United States Patent
Largo et al.

(10) Patent No.: US 10,625,406 B2
(45) Date of Patent: Apr. 21, 2020

(54) FASTENER-DRIVING TOOL INCLUDING A DRIVING DEVICE

(71) Applicant: Illinois Tool Works Inc., Glenview, IL (US)

(72) Inventors: Marc Largo, Gurnee, IL (US); Steve Carrington, Northbrook, IL (US); Nickolas Froggatt, Madison, WI (US); Xiaoyu Guo, Champaign, IL (US); Lucas Johnston, Channahon, IL (US); Sean Raines, Downers Grove, IL (US); Robbie Southerland, Champaign, IL (US); Kenton Wyckoff, Peoria, IL (US)

(73) Assignee: Illinois Tool Works Inc., Glenview, IL (US)

( * ) Notice: Subject to any disclaimer, the term of this patent is extended or adjusted under 35 U.S.C. 154(b) by 290 days.

(21) Appl. No.: 15/583,190

(22) Filed: May 1, 2017

(65) Prior Publication Data

US 2017/0232598 A1 Aug. 17, 2017

Related U.S. Application Data

(63) Continuation of application No. 14/253,517, filed on Apr. 15, 2014, now Pat. No. 9,643,306.

(51) Int. Cl.
*B25C 1/08* (2006.01)
*B25C 1/00* (2006.01)
(Continued)

(52) U.S. Cl.
CPC ..... *B25C 1/008* (2013.01); *B25C 1/06* (2013.01); *B25C 5/15* (2013.01); *B25C 5/16* (2013.01)

(58) Field of Classification Search
CPC .... B25C 1/00; B25C 1/04; B25C 1/06; B25C 1/008; B25C 1/08; B25C 5/15
(Continued)

(56) References Cited

U.S. PATENT DOCUMENTS 2,819,466 A 1/1958 Campbell et al.
3,924,692 A 12/1975 Saari
(Continued)

FOREIGN PATENT DOCUMENTS

TW 200906575 2/2009
WO 2007/142996 12/2007
WO 2008/123482 10/2008

OTHER PUBLICATIONS

International Search Report and Written Opinion for International Application No. PCT/US2015/024228, dated Jun. 30, 2015 (11 pages).

*Primary Examiner* — Scott A Smith
(74) *Attorney, Agent, or Firm* — Neal, Gerber & Eisenberg LLP

(57) ABSTRACT

A fastener-driving tool including a housing, a driving device associated with the housing and including a driver blade, a biasing member and a coupler attached to the driver blade and the biasing member, and a compound gear rotatably attached to the housing and in engagement with the coupler, where the compound gear is configured to rotate between a first position and a second position. The compound gear is rotated to the first position to move and secure the biasing member in a biased position when the driver blade is in a pre-drive position, and upon actuation, the biasing member is released from the biased position and biases the compound gear to move to the second position thereby causing the driver blade to move to a driven position for driving a fastener.

17 Claims, 9 Drawing Sheets

(51) Int. Cl.
*B25C 5/15* (2006.01)
*B25C 1/06* (2006.01)
*B25C 5/16* (2006.01)

(58) Field of Classification Search
USPC ..... 227/8, 131, 132, 134, 130, 136
See application file for complete search history.

(56) References Cited

U.S. PATENT DOCUMENTS 3,924,789 A 12/1975 Avery et al.
4,323,127 A 4/1982 Cunnigham
4,721,170 A 1/1988 Rees
4,724,992 A 2/1988 Ohmori
4,953,774 A 9/1990 Lai
5,069,379 A 12/1991 Kerrigan
5,320,270 A 6/1994 Crutcher
5,720,423 A 2/1998 Kondo et al.
5,927,525 A 7/1999 Moorman et al.
6,604,666 B1 8/2003 Pedicini et al.
6,997,367 B2 2/2006 Hu
7,494,037 B2 2/2009 Simonelli et al.
7,520,414 B2 4/2009 Blessing et al.
7,578,420 B2 8/2009 Tanimoto et al.
7,694,863 B2 4/2010 Spasov et al.
7,766,204 B2 8/2010 Spasov et al.
7,832,610 B2 11/2010 Tanimoto et al.
7,938,305 B2 5/2011 Simonelli et al.
8,393,512 B2 3/2013 Tanimoto et al.
8,505,798 B2 8/2013 Simonelli et al.
9,643,306 B2 * 5/2017 Largo ..... B25C 1/008
2005/0082334 A1 4/2005 Hu
2006/0175374 A1 8/2006 Zahner et al.
2006/0261127 A1 11/2006 Wolf et al.
2007/0023472 A1 2/2007 Schiestl
2008/0017689 A1 1/2008 Simonelli et al.
2008/0048000 A1 2/2008 Simonelli et al.
2008/0190986 A1 8/2008 Chang et al.
2008/0257934 A1 10/2008 Tanimoto et al.
2012/0211540 A1 8/2012 Kondou et al.

* cited by examiner

FASTENER-DRIVING TOOL INCLUDING A DRIVING DEVICE

This patent application is a continuation of and claims priority to and the benefit of U.S. patent application Ser. No. 14/253,517, which was filed on Apr. 15, 2014 now U.S. Pat. No. 9,643,306, the entire contents of which are incorporated herein by reference.

BACKGROUND

The present disclosure relates generally to powered, fastener-driving tools, wherein the tools may be electrically powered, pneumatically powered, combustion powered, or powder activated, and more particularly to a new and improved fastener-driving tool having a fastener driving device that is compact and utilizes fewer parts to make the tool lighter, more versatile and more efficient than conventional fastener-driving tools.

Powered, fastener-driving tools, of the type used to drive various fasteners, such as, for example, staples, nails, and the like, typically comprise a housing, a power source, a supply of fasteners, a trigger mechanism for initiating the actuation of the tool, and a workpiece-contacting element (also referred to herein as a "work contact element" or "WCE"). The workpiece-contacting element is adapted to engage or contact a workpiece, and is operatively connected to the trigger mechanism, such that when the workpiece-contacting element is in fact disposed in contact with the workpiece, and depressed or moved inwardly a predetermined amount with respect to the tool, the trigger mechanism is enabled so as to initiate actuation of the fastener-driving tool.

Fastener-driving tools also include a drive mechanism or driving device that generates the power for driving a fastener through a drive stroke and into a workpiece. For example, combustion-powered fastener-driving tools include a piston that reciprocally moves within a cylinder between a pre-drive position, i.e., top position in the cylinder, and a driven position, i.e., bottommost position in the cylinder. A driver blade is attached to the piston and contacts a fastener to drive the fastener into the workpiece when the piston moves to the driven or post-drive position. The power to move the piston and driver blade through the drive stroke, i.e., from the pre-drive position to the post-drive position, is generated by combustion that occurs in a combustion chamber positioned above the piston when the piston is in the pre-drive position. In pneumatic fastener-driving tools, compressed air is supplied to the tool and pushes against the piston to drive the piston through the drive stroke.

Each of the conventional fastener-driving tools, and more particularly, the driving devices in these tools, include several parts that interact with each other to generate the power for moving the piston through the drive stroke. As a result, the tool housing must be larger to contain the parts. Also, the additional parts make the tools heavier and more difficult to handle and manipulate during operation.

A need therefore exists for a fastener-driving tool that is compact, versatile and lighter so that the tool is readily, quickly and easily manipulated during operation.

SUMMARY

Various embodiments of present disclosure provide a new and improved fastener-driving tool having a driving device that is compact and utilizes fewer parts to make the tool lighter, more versatile and more efficient than conventional fastener-driving tools.

In an embodiment, a fastener-driving tool is provided and includes a housing, a driving device associated with the housing and including a driver blade, a biasing member and a coupler attached to the driver blade and the biasing member, and a compound gear rotatably attached to the housing and in engagement with the coupler, where the compound gear is configured to rotate between a first position and a second position. The compound gear is rotated to the first position to move and secure the biasing member in a biased position when the driver blade is in a pre-drive position, and upon actuation, the biasing member is released from the biased position and biases the compound gear to move to the second position thereby causing the driver blade to move to a driven position for driving a fastener.

In another embodiment, a fastener-driving tool is provided and includes a housing, a workpiece-contacting element movably connected to the housing, a trigger movably connected to the housing and configured to move between a rest position and an activated position, a driving device associated with the housing and including a driver blade, a spring and a belt attached to the driver blade and the spring, and a compound gear rotatably attached to the housing and in engagement with the belt. The compound gear is rotated relative to the housing and causes the belt to compress the spring when the driver blade is in a pre-drive position, and when the workpiece-contacting element is pressed against a workpiece and the trigger is moved to the activated position, the spring is released from the compressed position and expands thereby biasing the belt causing the compound gear to rotate and move the driver blade to a driven position for driving a fastener into a workpiece.

In a further embodiment, a fastener-driving tool is provided and includes a housing including a processor, a workpiece-contacting element and a trigger each movably connected to the housing and a driving device associated with the housing and including a driver blade, a biasing member and a coupler attached to the driver blade and the biasing member, where the driving device is in communication with the processor and configured to move the driver blade between a pre-drive position and a driven position. A compound gear is rotatably attached to the housing and in engagement with the coupler, the compound gear being configured to rotate between a first position associated with the pre-drive position and a second position associated with the driven position. In operation when a first input is activated, the processor causes the compound gear to rotate to an intermediate position between the first and second positions and partially compress the biasing member and move the driver blade a pre-set distance to an intermediate position between the pre-drive and driven positions. When a second input is activated, the processor causes the compound gear to rotate to the first position and fully compress the biasing member, and then release the biasing member causing the compound gear to move to the second position and the driver blade to move to the driven position for driving a fastener.

DETAILED DESCRIPTION

Figure 1:
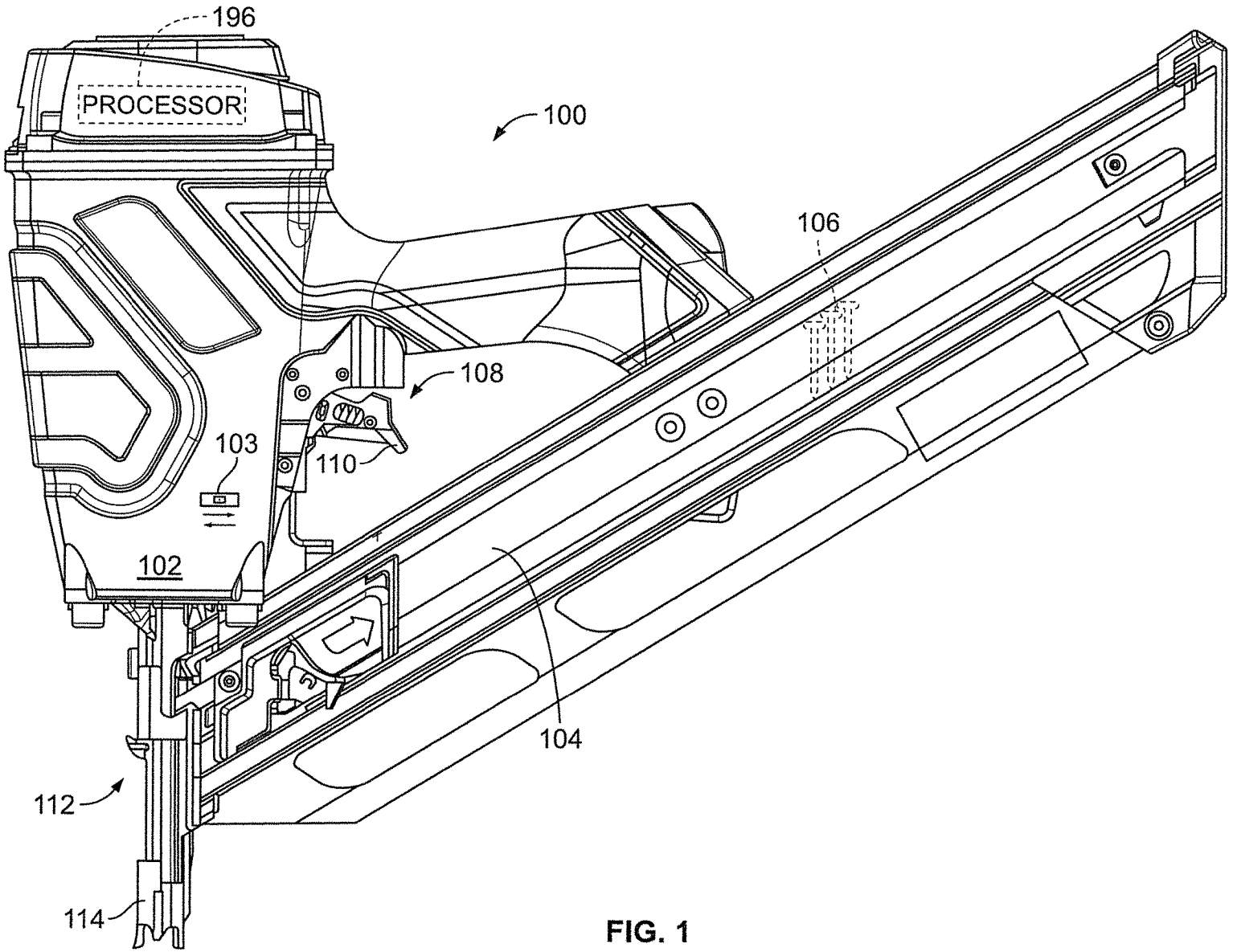
FIG. 1 is a side view of a fastener-driving tool of the present disclosure.

Referring now to FIGS. 1-4B, an example of a fastener-driving tool 100 according to the present disclosure is shown and includes a housing 102, a fastener magazine 104 containing a plurality of fasteners 106 (shown in phantom in FIG. 1) mounted to the housing and a trigger assembly 108 having a trigger 110 movably connected to the housing. A workpiece-contacting element assembly 112 includes a lower workpiece-contacting element or WCE 114, which is configured to contact the workpiece, and an upper workpiece-contacting element linkage member, which is slidably mounted in a reciprocal manner upon the tool housing 104. To drive a fastener into a workpiece, the lower workpiece-contacting element or WCE 114 is pressed against the workpiece thereby causing the WCE and the associated linkage member to move inwardly relative to the housing 102, and then the trigger 110 is actuated or pressed inwardly relative to the housing. The actuation sequence of pressing the WCE 114 against the workpiece and then actuating the trigger 110 is performed for each actuation of the tool in a sequential actuation mode.

Figure 2:
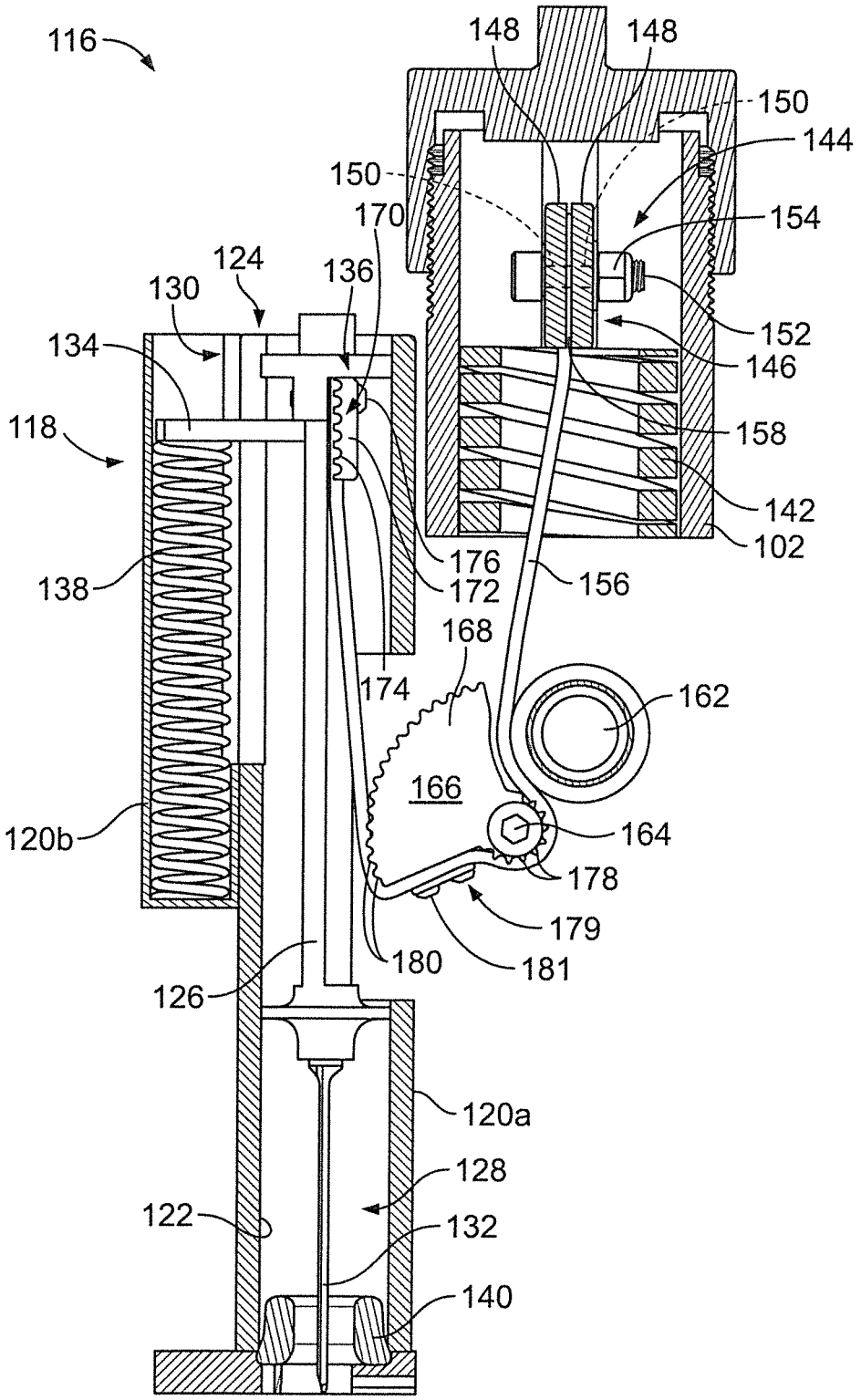
FIG. 2 is a fragmentary, enlarged cross-sectional view of an embodiment of a fastener-driving device of the present disclosure where the driver blade is in a pre-drive position.

The tool 100 further includes a driving assembly or driving device 116 that drives each fastener 106 into a workpiece. In an example embodiment shown in FIGS. 2 and 3, the driving device 116 includes a housing 118 having two chambers—a first chamber 120*a* and a second chamber 120*b*. The first chamber 120*a* defines an elongated drive channel 122 configured for receiving a fastener 106 from the magazine 104. A driver blade assembly 124 is reciprocally, movably mounted in the drive channel 122 and moves between a pre-drive position shown in FIG. 2 and a driven position or post-drive position shown in FIG. 3. The driver blade assembly 124 includes a shaft 126 having a first end 128 and a second end 130. As shown in FIG. 2, a driver blade 132 is mounted to the first end 128 of the shaft 126 and is configured to contact and drive a fastener 106 positioned in the drive channel 122. The second end 130 of the shaft 126 includes a transverse plate 134 extending from the first chamber 120*a* and at least partially into the second chamber 120*b*. As further described below, a drive belt mounting assembly 136 is also attached to the second end 130 of the shaft 126. To return the driver blade 132 to the pre-drive position, a biasing member, such as a return spring 138, is positioned in the second chamber 120*b* between an end of the second chamber and the transverse plate 134. It is contemplated that the return spring 138 may be a coil spring or any suitable spring and has a size configured to move the driver blade assembly 124 from the post-drive position to the pre-drive position. Additionally, an annular bumper 140 is positioned at a bottom end or lower end of the drive channel 122 as shown in FIG. 3 to at least partially absorb the impact forces of the driver blade assembly 124 on the housing 102 as the driver blade 132 drives a fastener 106.

The driving device 116 is powered by a biasing member, such as drive spring 142, coupled to the driver blade assembly 124 that provides the driving force for moving the driver blade through a drive stroke. It should be appreciated that the drive spring may be a coil spring or any suitable spring. Specifically, the drive spring 142 is positioned between a portion of the housing 102 and a mounting assembly 144. As shown in FIGS. 2 and 3, the mounting assembly 144 is connected to an end of the drive spring 142 and includes a clamp 146 having opposing clamp members 148. Each of the clamp members 148 includes a hole 150 where a threaded fastener such as a screw 152 is inserted through the holes and a nut 154 is attached to the threaded end of the screw. The nut 154 is rotated in a clockwise direction to move the clamp members 148 together, i.e., tighten the clamp, and in a clockwise direction to move the clamp members 148 apart from each other, i.e., loosen the clamp.

Figure 3:
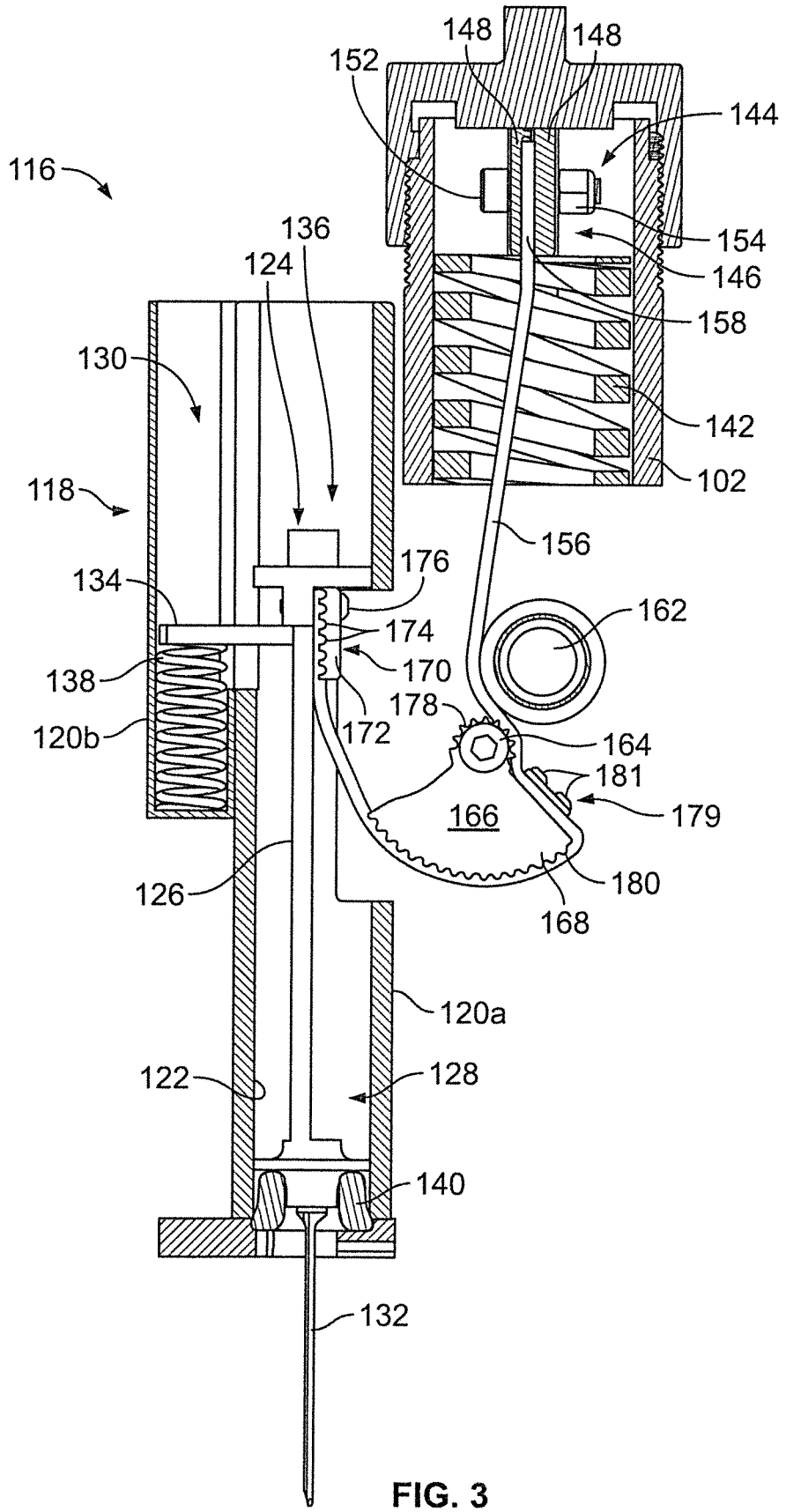
FIG. 3 is a fragmentary, enlarged cross-sectional view of the fastener-driving device of FIG. 2 where the driver blade is in a post-drive position.

Referring to FIGS. 2 and 3, a coupler or coupling device such as belt 156 is connected to the mounting assembly 144 and the driver blade assembly 124 for transferring the driving force generated by the drive spring 142 to the driver blade to drive a fastener 106 into a workpiece. A first end 158 of the belt 156 is positioned between the clamp members 148 and the clamp 146 is tightened to secure the belt to the mounting assembly. A second end 160 of the belt 156 is inserted through the drive spring 142, between a positioning post 162 and a first end or pivot end 164 of a compound gear 166, around a second end or drive end 168 of the compound gear and attached to a clamp 170 of the driver blade assembly 124. As shown in FIG. 2, a portion of the belt 156 is secured to the compound gear 166 by a gear mount 179 having fasteners 181 that each extend through the belt and into the compound gear. The clamp 170 associated with the driver blade assembly is similar to the clamp 146 of the mounting assembly. Specifically, the clamp 170 includes a plate 172 having a series of teeth 174. The second end 160 of the belt 156 is positioned between the plate 172 and the shaft 126 and a fastener such as screw 176 is inserted through holes (not shown) in the plate and the shaft. The screw 176 threadingly engages the hole in the shaft 126 such that rotating the screw in a clockwise direction moves the plate toward the shaft, and more particularly, causes the teeth to engage the second end 160 of the belt 156 to secure the second end of the belt to the driver blade assembly 124.

Figures 4A, 4B:
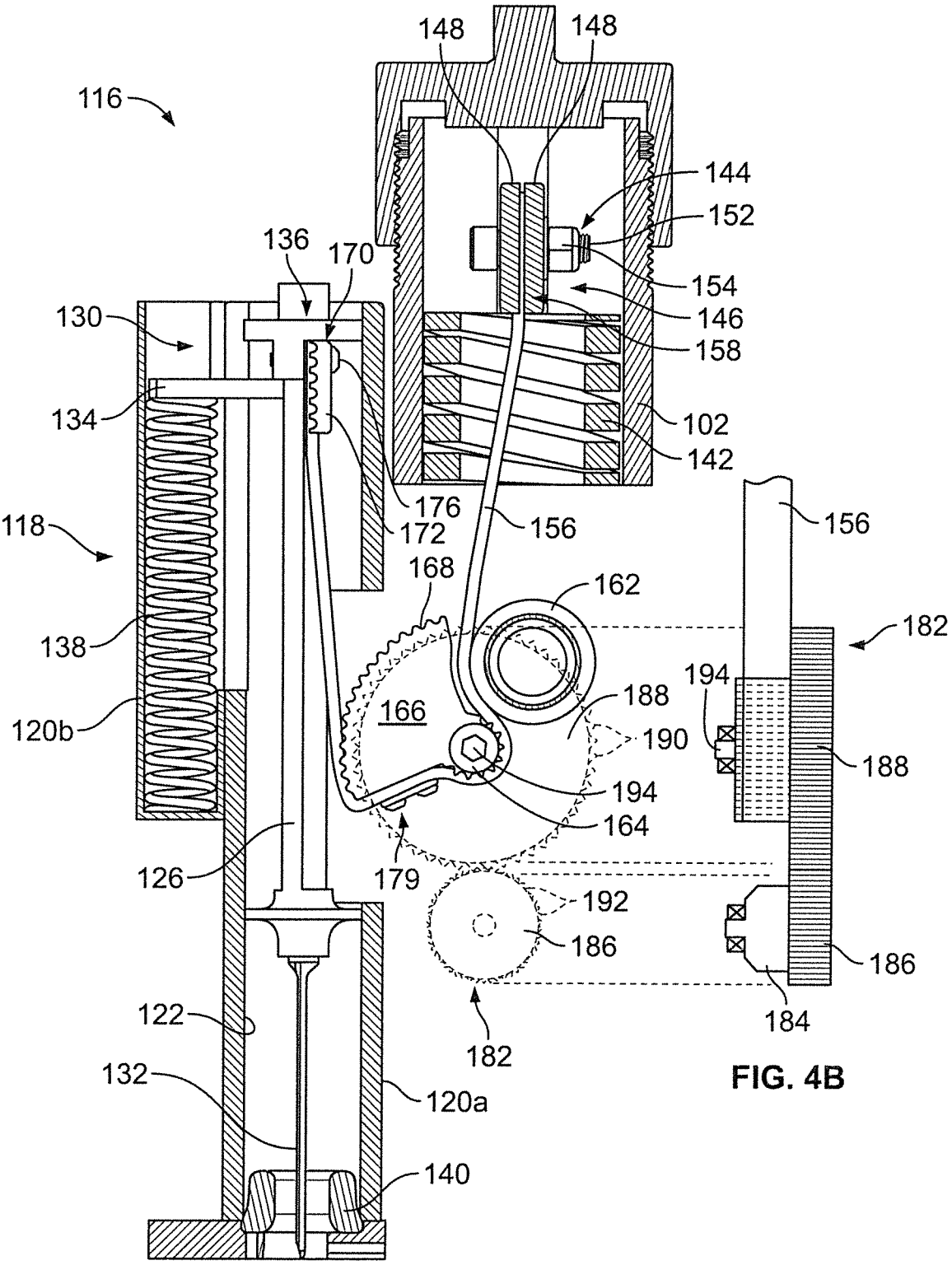
FIG. 4A is a fragmentary, enlarged cross-sectional view of the fastener-driving device of FIG. 2 showing the gears associated with the fastener-driving device.
FIG. 4B is an enlarged, fragmentary side view of the gears, motor and belt associated with the fastener-driving device of FIG. 4A.

The pivot and drive ends 164, 168 of the compound gear 166 respectively include teeth 178 and 180 that engage a surface of the belt 156 to securely grip the belt for driving the belt and thereby the driver blade 132. As shown in FIGS. 4A and 4B, the compound gear 166 is connected to a gear assembly 182 that couples the compound gear to an electric motor 184. The electric motor 184 is electrically coupled to a power source (not shown), such as a rechargeable battery or other suitable power source, and includes a drive gear 186. In particular, the drive gear 186 is rotatably connected to the motor 184 such that the motor rotates the drive gear when power is supplied to the motor. A driven gear 188 includes teeth 190 that matingly engage teeth 192 on the drive gear 186 such that rotation of the drive gear simultaneously rotates the driven gear. The driven gear 188 is coupled to the compound gear 166 by a shaft 194 where the compound gear rotates when the driven gear rotates. In operation, the motor 184 and gear assembly 182 rotate the compound gear 166 from a first position shown in FIG. 3 to a second position shown in FIG. 4A. As the compound gear 166 rotates to the second position, the teeth 180 on the drive end 168 of the compound gear engages the belt 156 and pulls the second end 160 of the belt downwardly against the drive spring 142, which compresses the drive spring. The compound gear 166 is held in this position by a one-way clutch or other latching device (not shown) until a user actuates the tool as described above. In this example embodiment, the motor 184 does not rotate the compound gear 166 in a counter-clockwise direction to supplement the driving force supplied to the driver blade assembly 124 during actuation of the tool. The driving force is solely provided by the drive spring 142. It should be appreciated that the motor may rotate the compound gear in a clockwise direction, counter-clockwise direction or in both a clockwise and counterclockwise direction and supplement the driving force generated by the drive spring.

Initially, the tool 100 includes a processor 196 (FIG. 1) such as a circuit board that is programmed to activate the motor 184 and rotate the compound gear 166 in a clockwise direction to compress the drive spring 142 prior to each actuation of the tool. To drive a fastener 106, the tool 100 and more specifically, the WCE 114 is pressed against a workpiece and the trigger 110 is pressed inwardly or activated. This operation sequence releases the compound gear 166 enabling it to freely rotate in the counter-clockwise direction due to the expansion of the drive spring 142. Rotation of the compound gear 166 pulls the first end 158 of the belt 156 and thereby the driver blade 132 through the drive channel 122 and into contact with a fastener 106 positioned in the drive channel to drive the fastener into the workpiece. As shown in FIG. 3, the movement of the driver blade 132 to the post-drive position causes the plate 134 to compress the return spring 138. After the fastener is driven into the workpiece, the return spring 138 expands and pushes against the plate 134 to move the driver blade 132 back to the pre-drive position.

Figure 5:
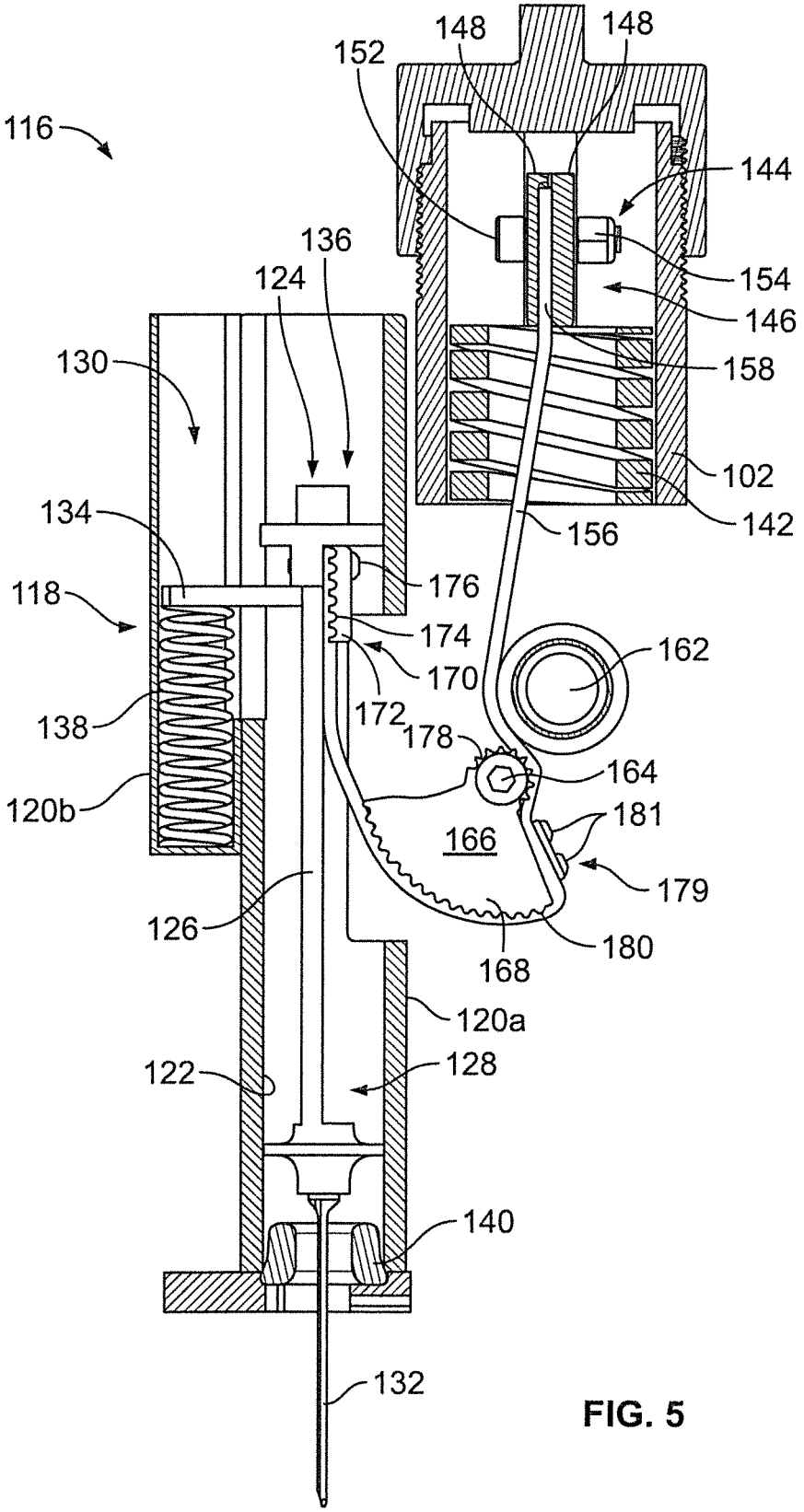
FIG. 5 is a fragmentary, enlarged cross-sectional view of another embodiment of a fastener-driving device of the present disclosure where the driver blade is in a pre-drive position.

Referring now to FIG. 5, another embodiment is illustrated where a controller, such as the processor 196 (FIG. 1), incorporates logic or is programmed to retract the driver blade 132 a pre-set or designated distance from the driven position (FIG. 3) and then fully retract and release the driver blade upon a second input. For example, the first input includes depressing the workpiece-contacting element 114 on a workpiece to start the above sequence which compresses the drive spring 142 and retracts the driver blade 132 the pre-set or designated distance, such as 80% of drive stroke distance. It should be appreciated that the driver blade 132 may be retracted to a position that is at any suitable percentage of the drive stroke or drive stroke distance, namely, between 0% to 100% of the drive stroke. Upon initiation of the second input, such as pressing the trigger 110, the sequence continues with the driver blade 132 continuing its retraction to 100% of the drive stroke, i.e., to the pre-drive position where the drive spring 142 is fully compressed as shown in FIG. 2, and then immediately releasing the driver blade to drive a fastener 106 (FIG. 1) into the workpiece. Alternatively, the sequence could be reversed through operation of a mode switch 103 (FIG. 1) on the tool housing 102 or other suitable control to reverse the order of the first and second inputs such that an operator first presses the trigger 110 to initiate the first input and retract the driver blade 132 and compress the drive spring 142 based on a pre-set retraction distance of the driver blade. Subsequently, when the operator depresses the workpiece-contacting element 114, the sequence continues, where the driver blade 132 fully retracts to the pre-drive position and then is immediately released to drive a fastener.

In this example, if the operator continues to depress the trigger 110, i.e., activates the first input, a contact actuation or "bump" fire mode is activated such that the driver blade 132 would again retract to 80% of the drive stroke and then drive a fastener upon activation of the second input, namely, depressing the workpiece-contacting element 114 on the workpiece. The tool continues to drive fasteners into the workpiece each time the workpiece-contacting element 114 is depressed against the workpiece until the trigger 110 is released by the operator or user. Accordingly, in this embodiment, the tool may be operated in either a sequential actuation mode or a contact actuation mode.

Furthermore, in an embodiment, the processor 196 is programmed with a "timeout" feature in which if the first input is activated but the second input is not activated after a designated or pre-determined amount of time, the driver blade 132 is slowly released to the pre-drive position by reversing the motor. By slowly releasing the driver blade 132, there is less stress on the drive spring 142 and thereby less opportunity for malfunction of the tool. It should be appreciated that the designated or pre-determined amount of time may be any suitable amount of time or time period.

Figure 6:
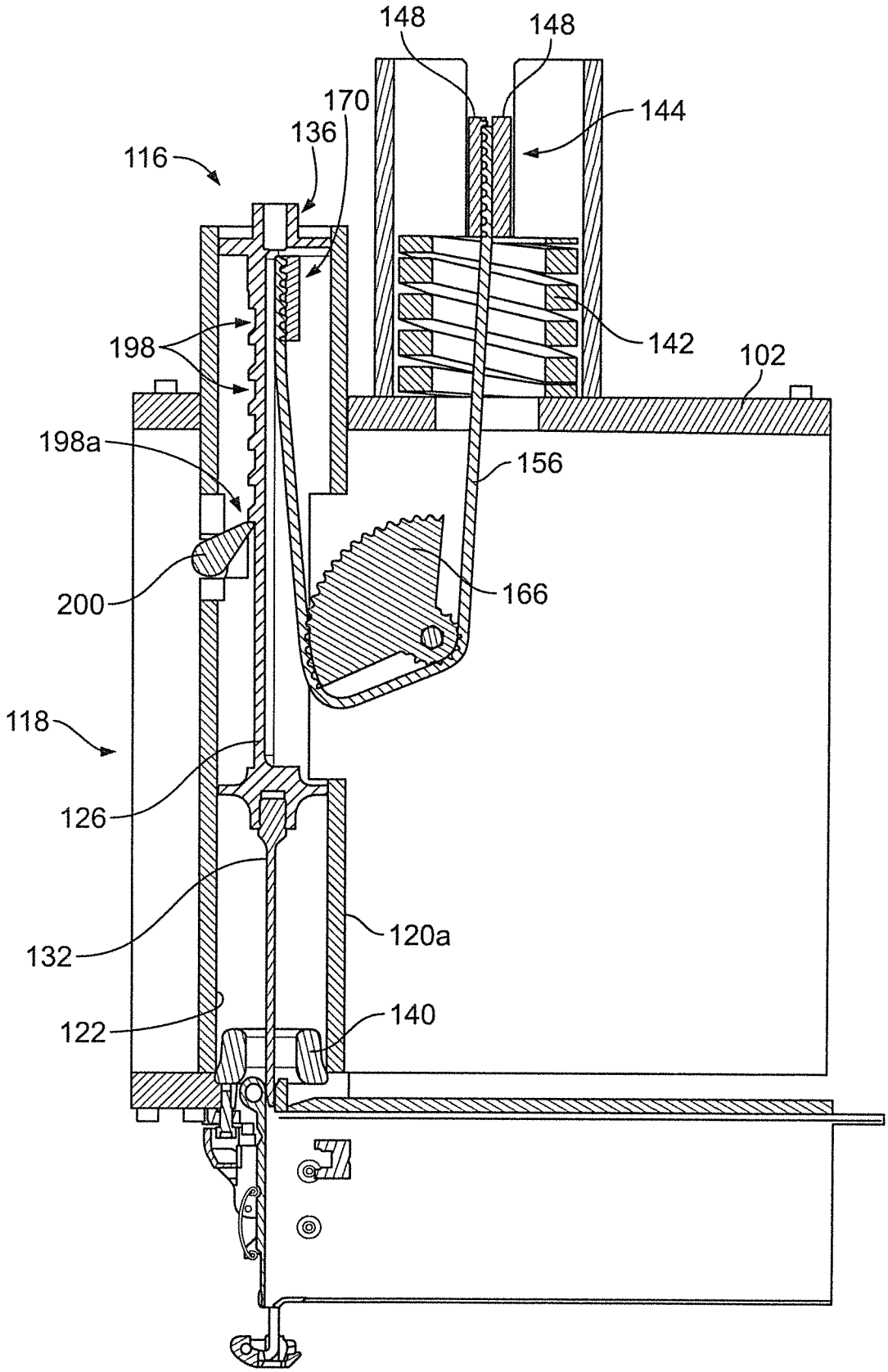
FIG. 6 is a fragmentary, enlarged cross-sectional view of the fastener-driving device of FIG. 5 where the driver blade is in a post-drive position.
Figure 7:
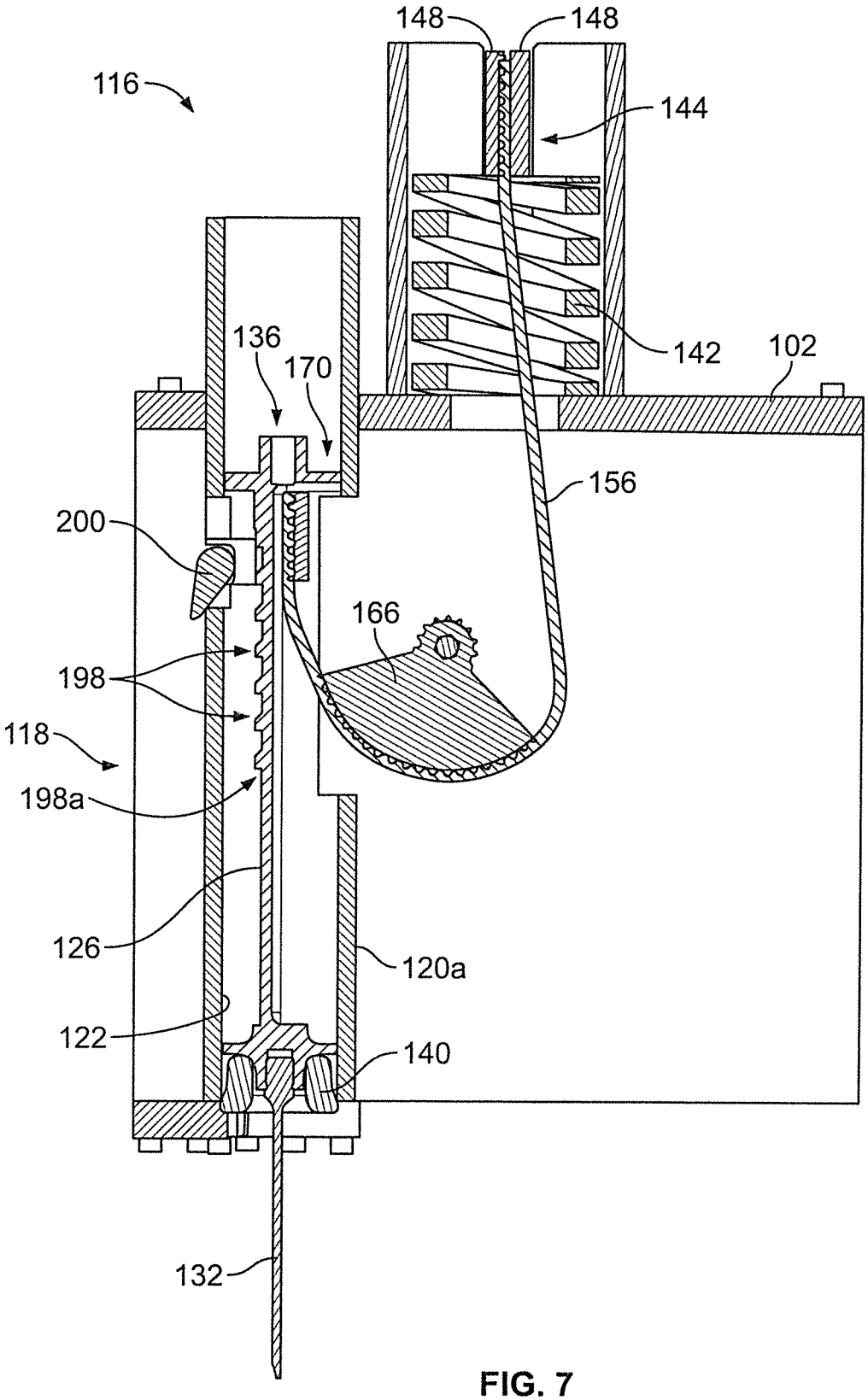
FIG. 7 is a fragmentary, enlarged cross-sectional view of a fastener-driving device associated with the tool of FIG. 1 where the driver blade is in a pre-drive position.

Referring now to FIGS. 6 and 7, a further example embodiment of the driving device 116 is illustrated where the shaft 126 of the driver blade assembly 124 includes at least one notch and preferably, a plurality of notches 198. A lock member 200 is rotatably connected to the housing 102 and positioned adjacent to the shaft 126 to engage one of the notches on the shaft. As shown in the illustrated embodiment, the lock member 200 engages the bottommost notch 198*a* on the shaft 126 to secure the driver blade assembly 124 in the pre-drive position as described above. In this embodiment, the lock member 200 is released or allowed to rotate in a clockwise direction based on a signal received from the processor 196 when the trigger 110 is activated. Rotation of the lock member 200 in the clockwise direction to the release position shown in FIG. 6 releases the driver blade assembly 124 and causes the driver blade 132 to move to the post-drive position as the drive spring 142 expands. The driver blade 132 is returned to the pre-drive position by the return spring 138 shown in FIGS. 2-4B or by a return spring positioned between the end of the driver blade assembly 124 and a portion of the housing 102.

Figure 8:
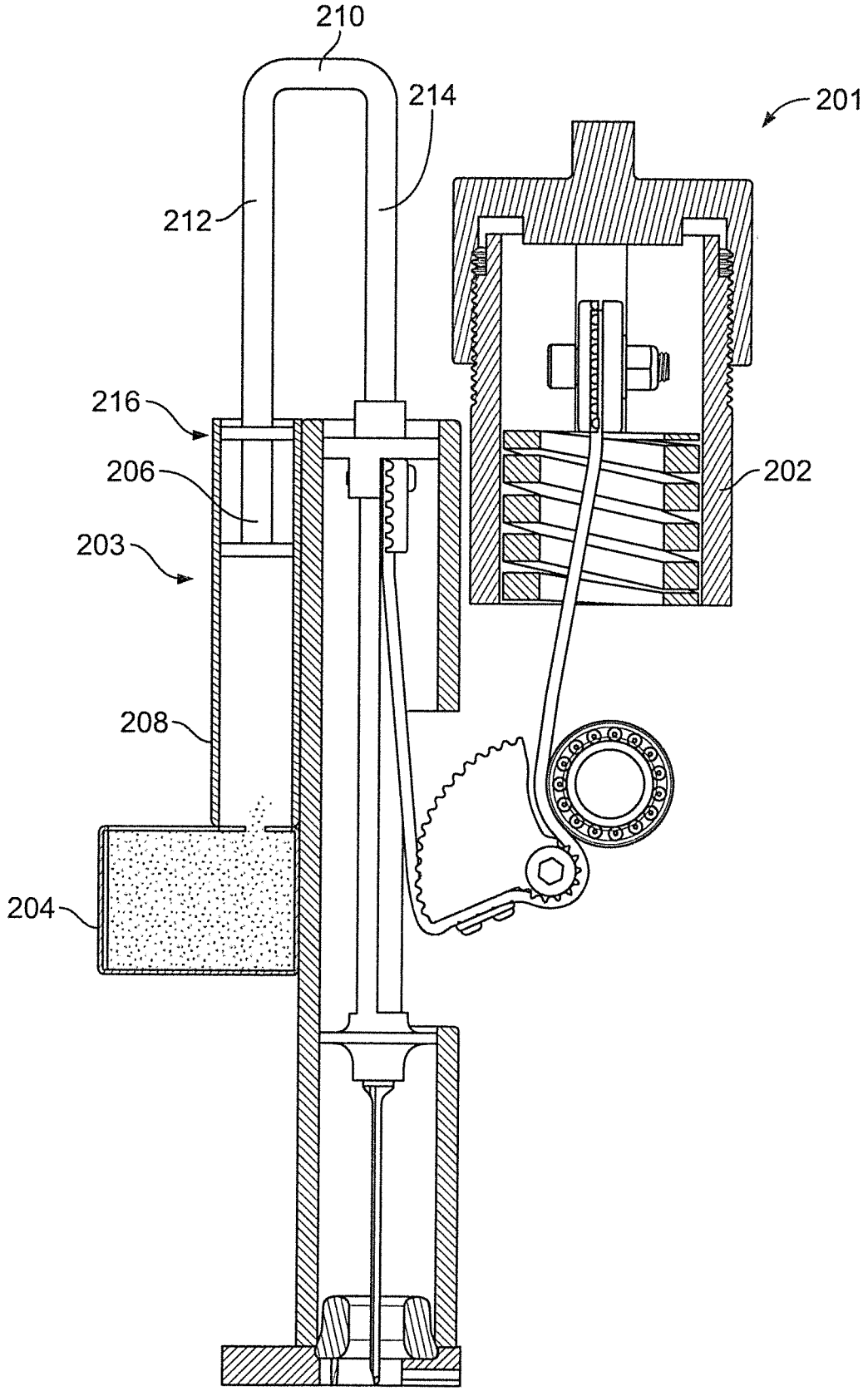
FIG. 8 is a fragmentary, enlarged cross-sectional view of a fastener-driving device associated with the tool of FIG. 1 including a sealed chamber configured to store a compressible gas used to return the driver blade to the pre-drive position.

Referring now to FIG. 8, a further example embodiment of a fastener-driving tool 201 (similar to the tool shown in FIG. 1) is illustrated and includes a driving device 203 where the tool housing 202 includes a sealed chamber 204 filled with a gas such as air, but preferably, a moistureless, compressible gas such as Nitrogen during assembly of the tool. It should be appreciated that the gas may be any suitable gas that has improved expansion characteristics over ambient air. In this embodiment, a piston 206 reciprocally moves within air chamber 208 defined by the housing 202 where chamber 208 is in communication with the sealed chamber 204. A U-shaped connector 210 includes a first end 212 and a second end 214 where the first end is attached to the piston 206 and the second end is attached to the driver blade assembly 124 (FIGS. 2 and 3). As a fastener is driven into a workpiece, the piston moves within the air chamber 208 toward the sealed chamber 204 to decrease the volume in front of or ahead of the piston in air chamber 208 and chamber 204 thereby compressing the gas in chambers 204 and 208 such that the compressed gas exerts pressure on the piston. Thus, after the fastener is driven into the workpiece as described above, the pressure of the compressed gas pushes against the piston 206 to move or return the piston 206 to a top end 216 of the air chamber 208. This causes the U-shaped connector 210 to move upwardly thereby moving the driver blade assembly 124 to the pre-drive position. The driver blade assembly 124 is secured in the pre-drive position by temporarily locking the compound gear 166, using the lock member 200 of FIGS. 6-7 or any other suitable locking or latching device until actuation of the tool.

Figure 9:
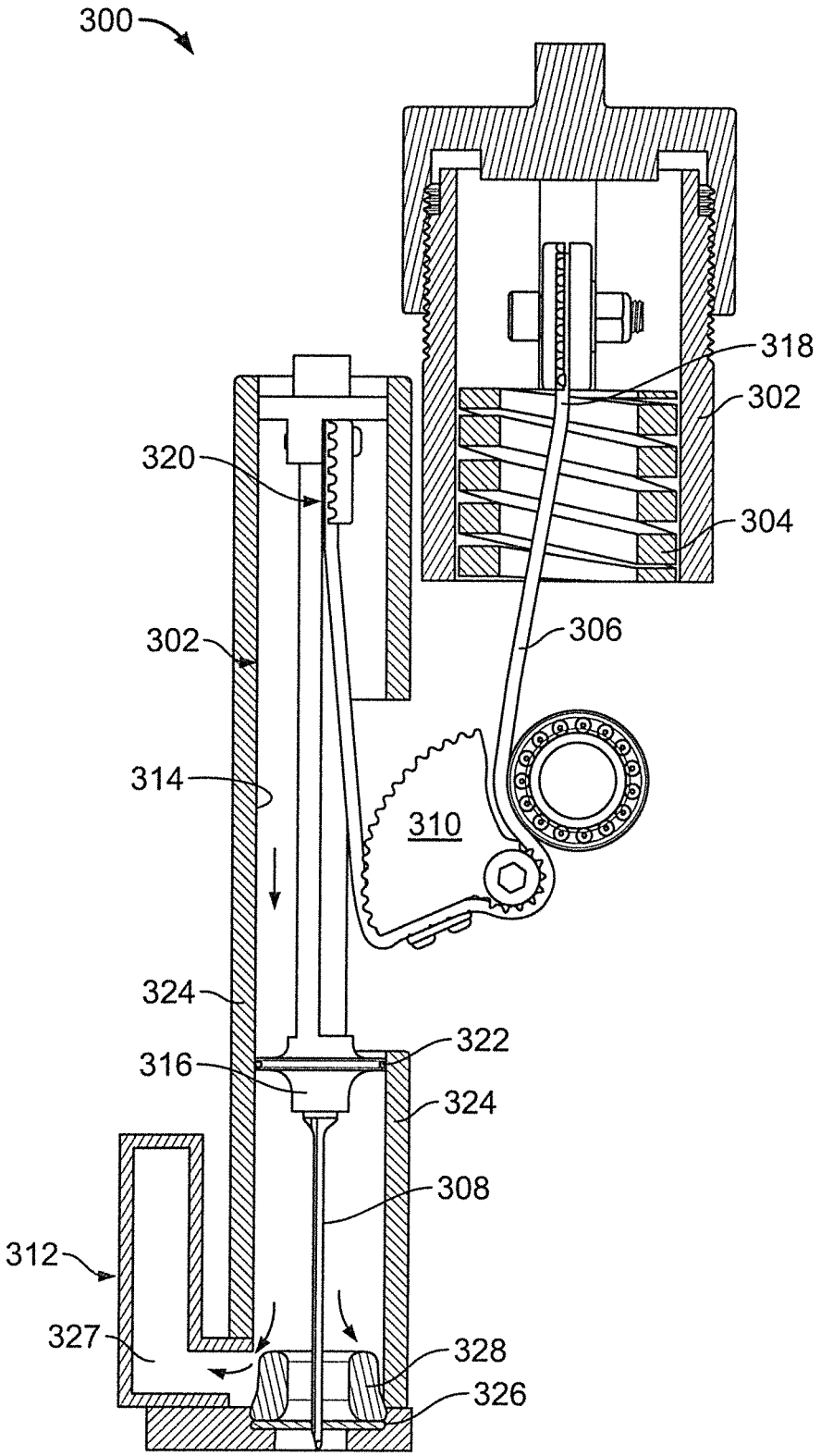
FIG. 9 is a fragmentary, enlarged cross-sectional view of a fastener-driving device associated with the tool of FIG. 1 including an auxiliary chamber used to return the driver blade to the pre-drive position.

Referring now to FIG. 9, another embodiment of the fastener-driving tool is illustrated and generally designated with reference number 300. The tool 300 includes a housing 302, a biasing member such as drive spring 304 in the housing, a belt 306 attached to the drive spring 304 and to a driver blade 308 and a compound gear 310 positioned adjacent to the belt. An auxiliary chamber 312 is attached to the housing 302, and more specifically, to the driver blade channel or drive channel 314. The auxiliary chamber 312 has a designated size and volume that is less than a size and volume of the portion of the drive channel 314 that is beneath piston 316 when the piston is in the pre-drive position.

In operation, when the drive spring 304 is released by actuation of the trigger or another actuation event, the end 318 of the belt 306 moves with the drive spring and causes the compound gear 310 to rotate in a counter-clockwise direction. In turn, the other end 320 of the belt 306 pulls the driver blade 308 through a drive stroke to drive a fastener into a workpiece. As shown in FIG. 9, the piston 316 includes at least one first seal member, such as o-ring 322, to form a seal between the piston 316 and an inner surface of the walls 324 forming the drive channel 314. A second seal member 326 is positioned at an end of the drive channel 314 to form a seal with the driver blade 308. The first and second seal members 322 and 326 help to prevent air 327 from moving past the piston 316 or out the bottom of the drive channel 314 when the driver blade 308 is moving through a drive stroke. As the driver blade 308 moves through the drive stroke, the air 327 in the drive channel 314 beneath the piston 316 is forced into the auxiliary chamber 312 as shown by the arrows in FIG. 9. As stated above, the auxiliary chamber 312 has a size and volume that is less than the size and volume of the space in the drive channel 314 beneath the piston 316 (i.e., between the piston and the auxiliary chamber) such that the air beneath the piston is compressed a designated amount when the piston contacts bumper 328. As the compressed air expands, it pushes against the piston 316 and moves the piston through the drive channel 314 to the pre-drive position. It should be appreciated that the size and volume of the auxiliary chamber 312 may be any suitable size and volume that enables the air in the drive channel 314 to be compressed a sufficient amount to return the piston 316 to the pre-drive position when the air expands after a fastener is driven into a workpiece. It should also be appreciated that a gas other than air may be supplied to the drive channel 314 and/or the auxiliary chamber 312 during assembly of the tool.

While a particular embodiment of a powered fastener-driving tool has been described herein, it will be appreciated by those skilled in the art that changes and modifications may be made thereto without departing from the invention in its broader aspects and as set forth in the following claims.

The invention claimed is:

1. A fastener-driving tool comprising:

a driver blade assembly movable between a pre-drive position and a driven position, wherein movement of the driver blade assembly from the pre-drive position to the driven position causes a fastener to be driven;

a coupler attached to the driver blade assembly, wherein the coupler comprises a belt; and a coupler engager engaged to the coupler and movable:

in a first direction to cause the driver blade assembly to move from the pre-drive position to the driven position; and in a second direction different from the first direction to cause the driver blade assembly to move from the driven position to the pre-drive position.

2. The fastener-driving tool of claim 1, wherein the first and second directions are different rotational directions.

3. The fastener-driving tool of claim 2, wherein the coupler engager comprises a compound gear.

4. The fastener-driving tool of claim 1, wherein the coupler engager comprises multiple elements that engage the coupler.

5. The fastener-driving tool of claim 1, further comprising a return spring biasing the driver blade assembly toward the pre-drive position.

6. The fastener-driving tool of claim 1, further comprising a motor operatively connected to the coupler engager to move the coupler engager to the first position.

7. A fastener-driving tool comprising:

a driver blade assembly movable between a pre-drive position and a driven position;

a biasing member;

a coupler attached to the driver blade assembly and the biasing member; and a coupler engager movable between a first rotational position and a second rotational position, wherein the coupler engager is engaged to the coupler such that release of the biasing member from a biased position causes the coupler engager to move to the second rotational position and the driver blade assembly to move to the driven position.

8. The fastener-driving tool of claim 7, wherein movement of the coupler engager from the second rotational position to the first rotational position causes the biasing member to move to the biased position.

9. The fastener-driving tool of claim 8, further comprising a motor operatively connected to the coupler engager to move the coupler engager to the first rotational position.

10. The fastener-driving tool of claim 7, further comprising a return spring biasing the driver blade assembly toward the pre-drive position.

11. The fastener-driving tool of claim 7, wherein the coupler engager comprises a compound gear.

12. The fastener-driving tool of claim 7, wherein the coupler comprises a belt.

13. The fastener-driving tool of claim 12, wherein the coupler engager comprises multiple elements that engage the coupler.

14. A fastener-driving tool movable between a pre-drive configuration and a driven configuration, the fastener-driving tool comprising:

a driver blade assembly movable between a pre-drive position and a driven position;

a biasing member;

a coupler attached to the driver blade assembly and the biasing member; and a coupler engager movable between a first rotational position and a second rotational position, wherein when the fastener-driving tool is in the pre-drive configuration, the driver blade assembly is in the pre-drive position, the biasing member is in a biased position, and the coupler engager is in the first rotational position and engages the coupler, and wherein when the fastener-driving tool is in the driven configuration, the driver blade assembly is in the driven position, the biasing member is not in the biased position, and the coupler engager is in the second rotational position and engages the coupler.

15. The fastener-driving tool of claim 14, wherein the coupler engager comprises a compound gear.

16. The fastener-driving tool of claim 14, wherein the coupler comprises a belt.

17. The fastener-driving tool of claim 16, wherein the coupler engager comprises multiple elements that engage the coupler.

* * * * *